US008614931B2

(12) United States Patent
Moulin et al.

(10) Patent No.: US 8,614,931 B2
(45) Date of Patent: Dec. 24, 2013

(54) TIMEPIECE MOVEMENT COMPRISING A MODULE FITTED WITH A WHEEL SET MESHING WITH ANOTHER WHEEL SET PIVOTING IN A BASE ON WHICH THE MODULE IS MOUNTED

(75) Inventors: Julien Moulin, Volleges (CH); Ivan Villar, Bienne (CH); Laurent Kaelin, Sonvilier (CH); Baptist Wyssbrod, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 13/546,692

(22) Filed: Jul. 11, 2012

(65) Prior Publication Data

US 2013/0016590 A1 Jan. 17, 2013

(30) Foreign Application Priority Data

Jul. 13, 2011 (EP) ..... 11005713

(51) Int. Cl.
*G04B 19/02* (2006.01)
*G04B 15/00* (2006.01)

(52) U.S. Cl.
USPC ..... 368/220; 368/124

(58) Field of Classification Search
USPC ..... 368/80, 124, 127, 220
See application file for complete search history.

(56) References Cited

U.S. PATENT DOCUMENTS

| | | | | |
|---|---|---|---|---|
| 1,392,006 | A | 9/1921 | Freund | |
| 3,121,990 | A * | 2/1964 | Laviolette | 368/127 |
| 3,802,183 | A | 4/1974 | Erard | |
| 3,892,068 | A | 7/1975 | Erard | |
| 3,945,197 | A | 3/1976 | Erard | |
| 3,968,642 | A * | 7/1976 | Burki | 368/318 |
| 4,023,348 | A | 5/1977 | Giger et al. | |
| 8,238,201 | B2 * | 8/2012 | Martinez et al. | 368/220 |
| 8,331,202 | B2 * | 12/2012 | Martinez et al. | 368/80 |
| 2010/0290321 | A1 | 11/2010 | Martinez et al. | |
| 2011/0038233 | A1 | 2/2011 | Martinez et al. | |

FOREIGN PATENT DOCUMENTS

| | | |
|---|---|---|
| CH | 578 203 | 7/1976 |
| CH | 581 342 | 10/1976 |
| EP | 2 085 833 A1 | 8/2009 |
| FR | 2 229 087 | 12/1974 |
| FR | 2 282 554 | 3/1976 |

OTHER PUBLICATIONS

European Search Report issued Dec. 15, 2011, in European Patent Application No. 11005713.0, filed Jul. 13, 2011.

* cited by examiner

*Primary Examiner* — Vit W Miska
(74) *Attorney, Agent, or Firm* — Oblon, Spivak, McClelland, Maier & Neustadt, L.L.P.

(57) ABSTRACT

Timepiece movement including a module fitted with a first wheel set meshing with a second wheel set, which pivots on a base on which the module is mounted. The movement includes a means of positioning the module formed by a cam, at least most of the periphery of which forms an Archimedes' spiral. The cam is arranged so as to allow the distance of centers between the first and second wheel sets to be adjusted, when the cam is rotated on itself about the center of the Archimedes' spiral. The cam is preferably calibrated. The invention also concerns a method of adjusting the distance of centers between the two wheel sets using said cam to optimise the gearing efficiency of the two wheel sets.

10 Claims, 5 Drawing Sheets

TIMEPIECE MOVEMENT COMPRISING A MODULE FITTED WITH A WHEEL SET MESHING WITH ANOTHER WHEEL SET PIVOTING IN A BASE ON WHICH THE MODULE IS MOUNTED

FIELD OF THE INVENTION

The present invention concerns a timepiece movement comprising a module fitted with a first wheel set meshing with a second wheel set which pivots in a base on which the module is mounted. In particular, the invention concerns a timepiece movement including a platform escapement which forms a module in which the escapement is arranged, i.e. the sprung balance, the pallet fork and the escape wheel set. This escape wheel set is formed of an escapement plate and an escape pinion which, in the finished movement, meshes with a gear train wheel mounted on the bottom plate to which the platform escapement is fixed.

BACKGROUND OF THE INVENTION

When there is no particular problem in fixing the module to the base of the timepiece movement, particularly to the bottom plate, by a vertical translation which enables a first wheel set of the module to mesh with a second wheel set pivoting in the base, the module is generally positioned by two feet (or pins) machined or arranged in the base, which penetrate two respective holes machined in a plate or bar of the module. Once positioned, the module is secured by at least one screw to the base. Given the manufacturing tolerances for the feet, holes and bearings of the first and second wheel sets in various parts of the ébauche, the positioning of the module is approximate and there is a significant variation in the distance of centres of the first and second wheel sets. This gives rise to a real problem for the rate of the timepiece movement, since, if the gearing of the first and second wheel sets is not optimal, efficiency is reduced and becomes variable. The amplitude of the balance is generally reduced and this affects the rate accuracy of the timepiece. In this respect, accurate and well defined meshing between the gear train and the platform escapement exit is particularly important.

It is not generally possible to position the module by a simple vertical translation. One solution to this particular problem is given in the following Patent documents: CH-578203/U.S. Pat. No. 3,802,183 and CH-581342/U.S. Pat. No. 3,945,197. These documents propose assembling a platform escapement by performing a vertical translation to arrange a guide hole in the platform escapement on one foot of the bottom plate (an internal threaded cylinder or pin for a fixing screw) about which it can rotate. Next, the platform escapement is rotated until two respective parts of the platform escapement and the rest of the movement are abutting against each other. In the first document, a column (pin) of the platform escapement abuts against a side wall of a bar in which the fourth wheel set pivots. The escape pinion must mesh with the fourth wheel set. In the second document, one area of a plate of the platform escapement abuts against a bar mounted on the bottom plate. In both cases, the problem of various manufacturing tolerances which vary the distance of centres of the escape pinion and the fourth wheel remains unchanged.

FIGS. 1 to 3 show a movement in which a platform escapement 2 is mounted on a bottom plate 4 in accordance with the aforementioned technique. Escape wheel set 6 is pivotally mounted between a lower plate 8 and a top bar 10 of the platform escapement, as is the balance 12. In FIG. 1, the platform escapement is mounted on a foot or, as shown, on an internally threaded cylinder 16, about which it can turn to be brought, via a horizontal rotation, into a final position shown in FIGS. 2 and 3. In this final position, pinion 18 of the escape wheel set meshes with a gear train wheel 14 mounted on the bottom plate. To hold the platform escapement in its final position, two screws are provided; the first is screwed into cylinder 16 and the second is screwed into a threaded hole 20 in the bottom plate through a truncated hole 22 in top bar 10. The assembly tolerances of the escape wheel set and wheel 14 in the platform escapement and on the bottom plate respectively mean that it is not possible to obtain a precise, predetermined distance of centres. Moreover, the assembly of the platform escapement on the bottom plate has a large tolerance which considerably increases the problem. Thus, the penetration of the toothing of pinion 18 in the toothing of wheel 14 is not precisely determined and has a variable, uncontrolled nature, which has a negative influence on the operation of the escapement.

Generally, when a module, which forms a distinct unit with at least a first wheel set pivoting therein, is arranged on a timepiece movement base and the first wheel set has to mesh with a second wheel set pivoting on the base, there is a problem linked to the fact that the distance of centres of the first and second wheel sets varies around the optimum distance of centres; which affects the proper operation of the timepiece movement. Indeed, the gearing between the first and second wheel sets is made worse by numerous manufacturing tolerances; particularly with the modular construction provided here. It is therefore difficult to obtain a predetermined distance of centres.

SUMMARY OF THE INVENTION

It is an object of the present invention to overcome the aforementioned problem of a randomly variable distance of centres in a modular construction.

The present invention therefore concerns a timepiece movement including a module, fitted with a first wheel set which meshes with a second wheel pivoting in a base on which the module is mounted, and a means of positioning the module on the base. The positioning means is formed by a cam, at least most of the profile/periphery of which forms an Archimedes' spiral or an optimized Archimedes' spiral, said cam being arranged so that it can adjust the distance of centres between the first and second wheel sets when the cam is rotated about the geometric centre of said Archimedes' spiral or said optimized Archimedes' spiral. The cam is preferably calibrated.

The invention also concerns a method of adjusting the distance of centres between a first timepiece wheel set, pivotally mounted in a module which is able to undergo a rotation about a geometric axis relative to a base on which it is mounted, and a second timepiece wheel set pivoting on said base. The steps of this method are set out in the annexed claim 6.

In a particular embodiment of the invention, the module is a platform escapement, the first wheel set is the escape pinion and the second wheel set is a gear train wheel mounted on a bottom plate forming the base.

Other particular features of the invention will be set out below in the detailed description of the invention.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
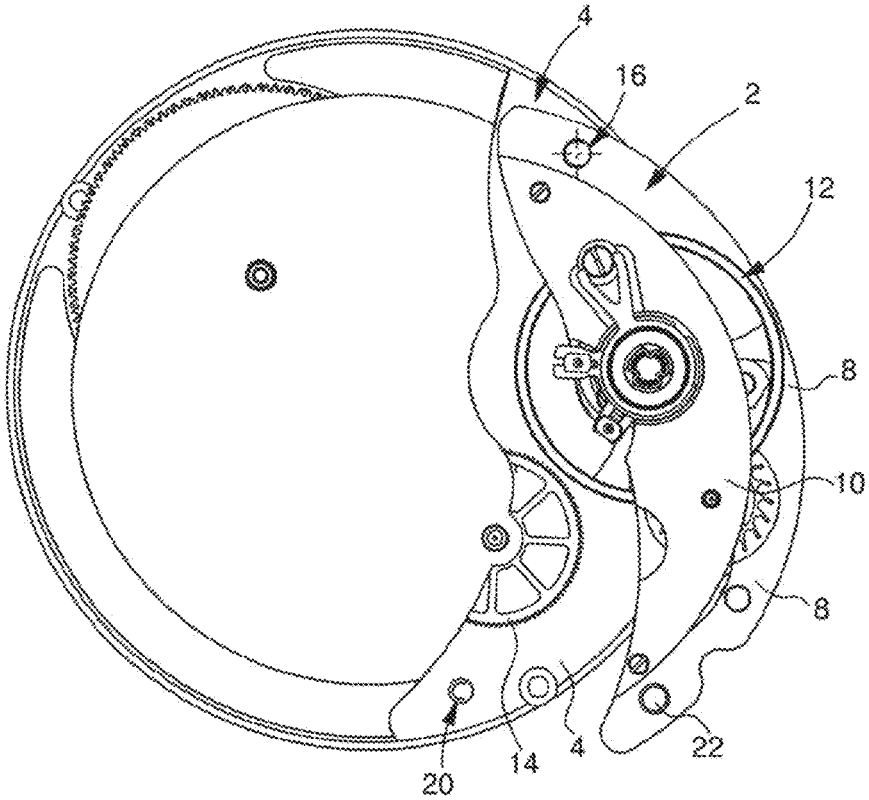
Fig. 1 (Prior Art)
FIG. 1 is a top view of a prior art movement, on which a platform escapement is mounted, with the latter in its initial assembly position in the movement.
Figure 2:
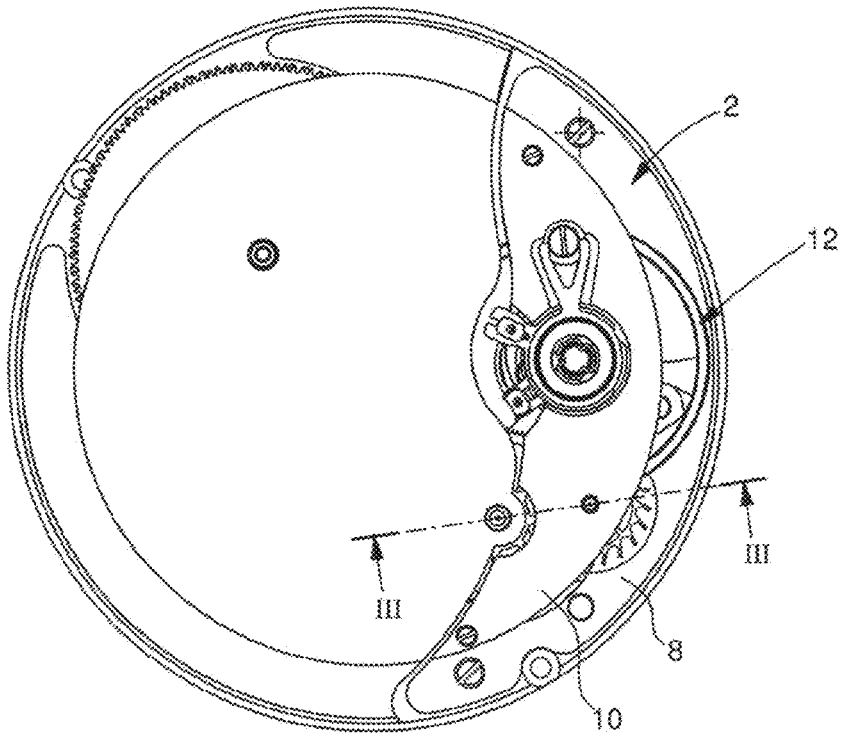
Fig. 2 (Prior Art)
FIG. 2 is a top view of the movement of FIG. 1 with the platform escapement in a final position.
Figure 3:
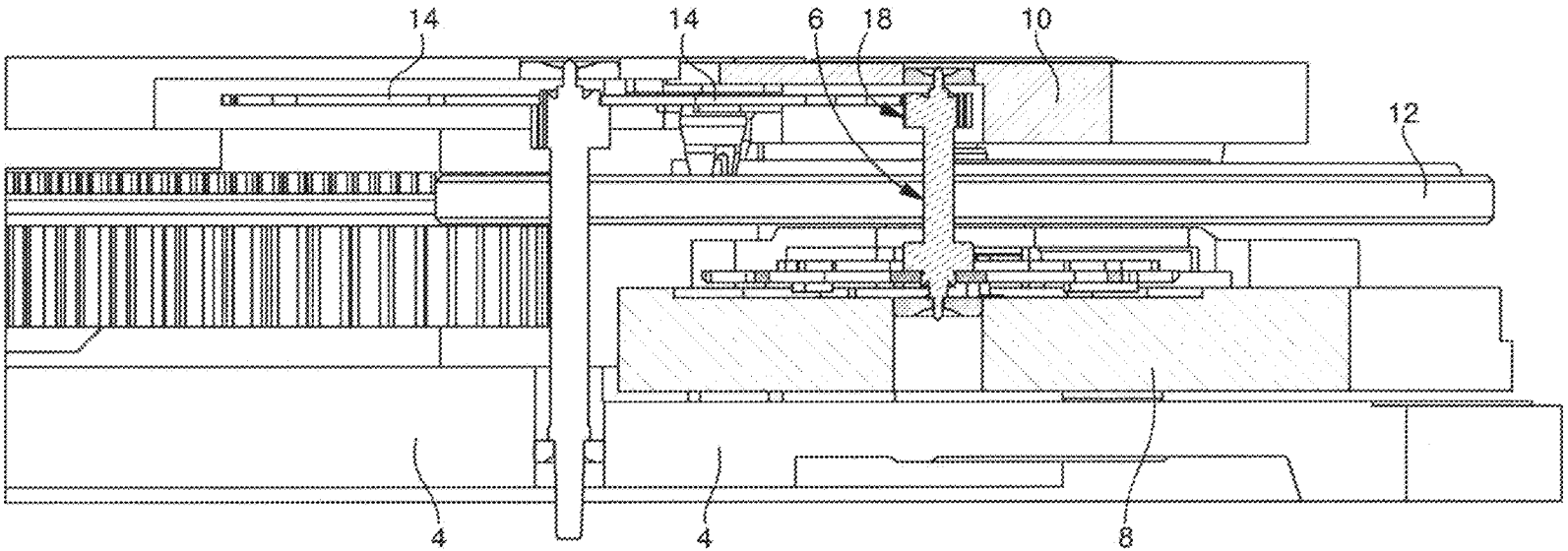
Fig. 3 (Prior Art)
FIG. 3 is a cross-section along the line III-III of FIG. 2.
Figure 4:
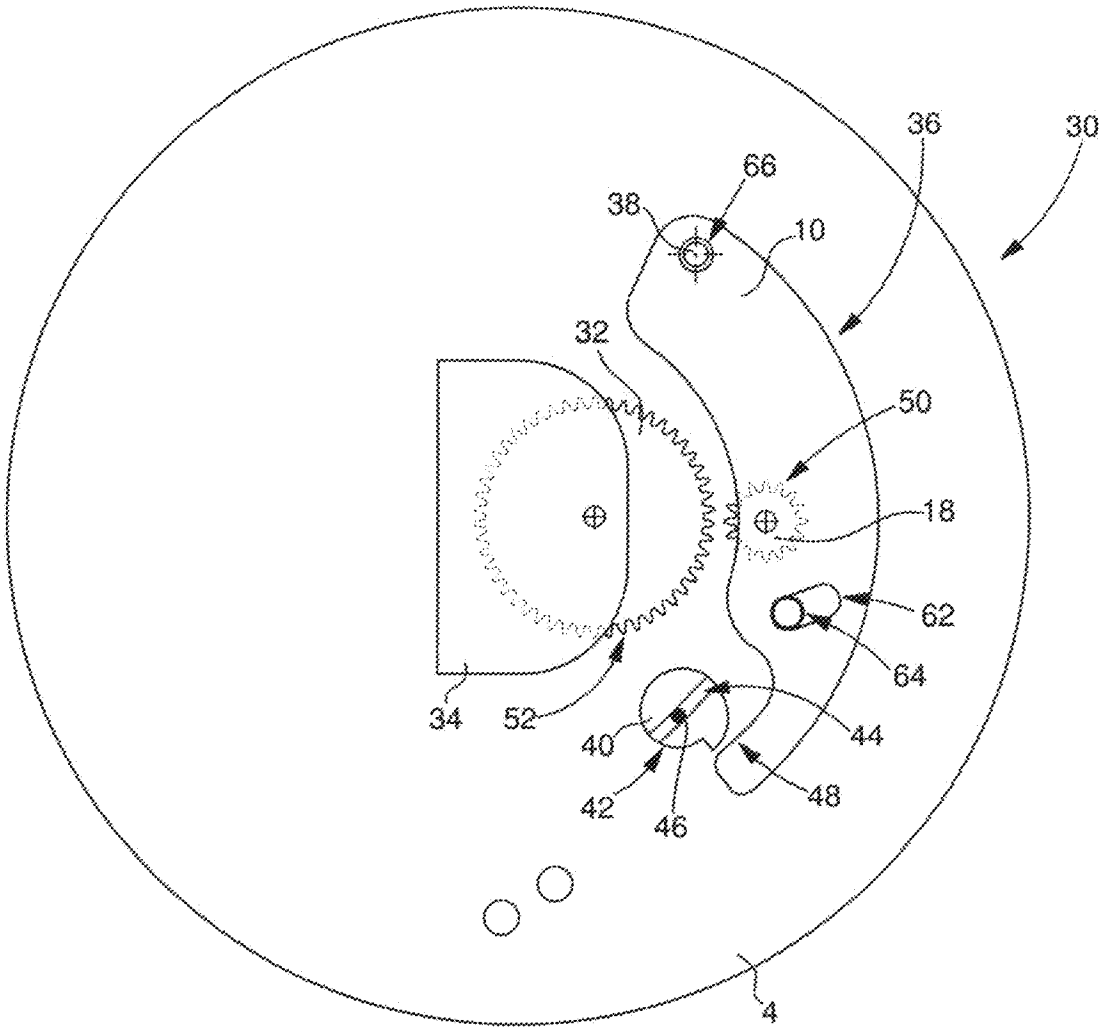
FIG. 4 is a partial, schematic, top view of an embodiment of a timepiece movement in which a platform escapement according to the invention is mounted, with said platform escapement in an initial position.
Figure 5:
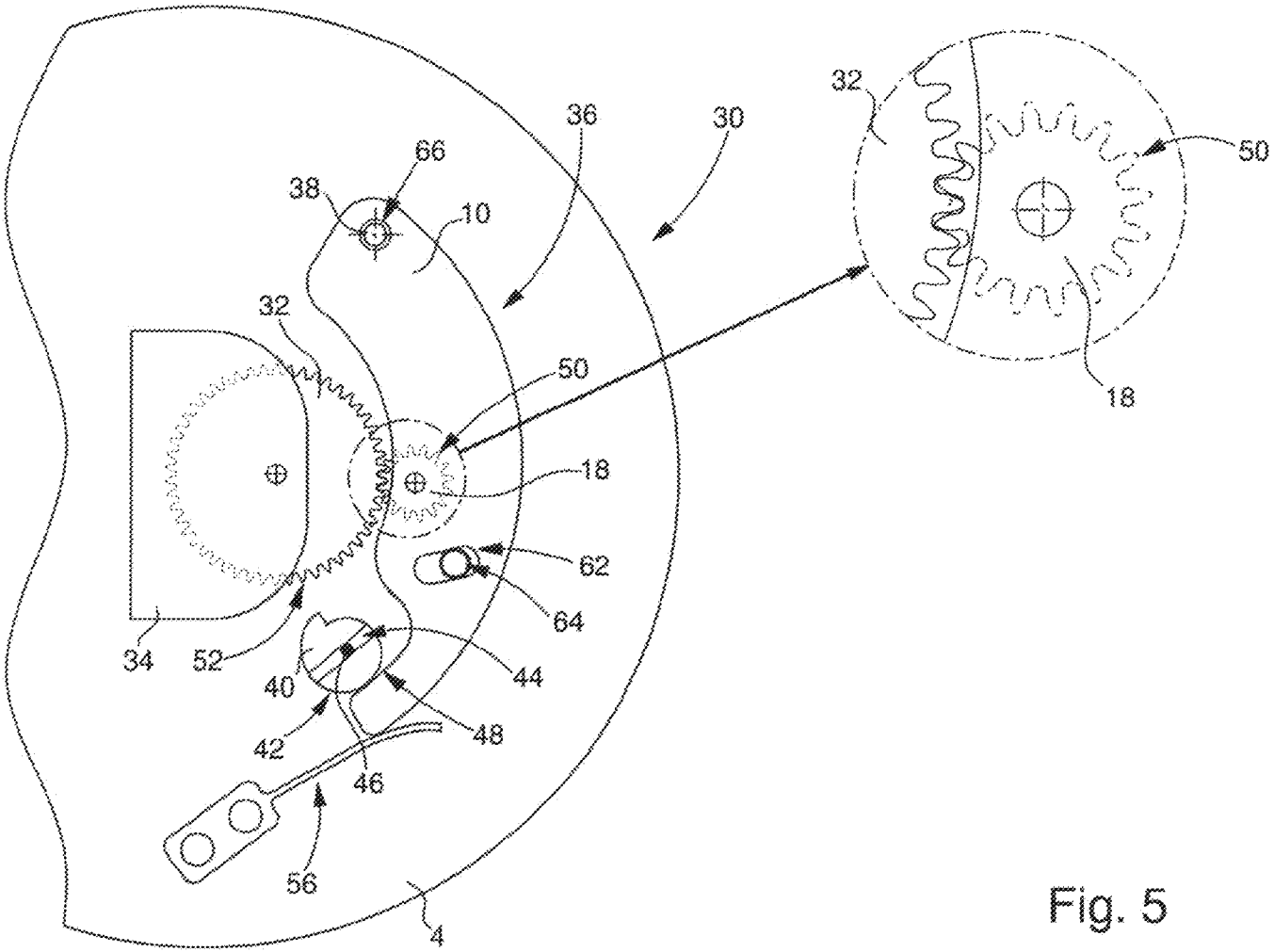
FIG. 5 is a similar view to that of FIG. 4 with the platform escapement in an intermediate assembly position.
Figure 6:
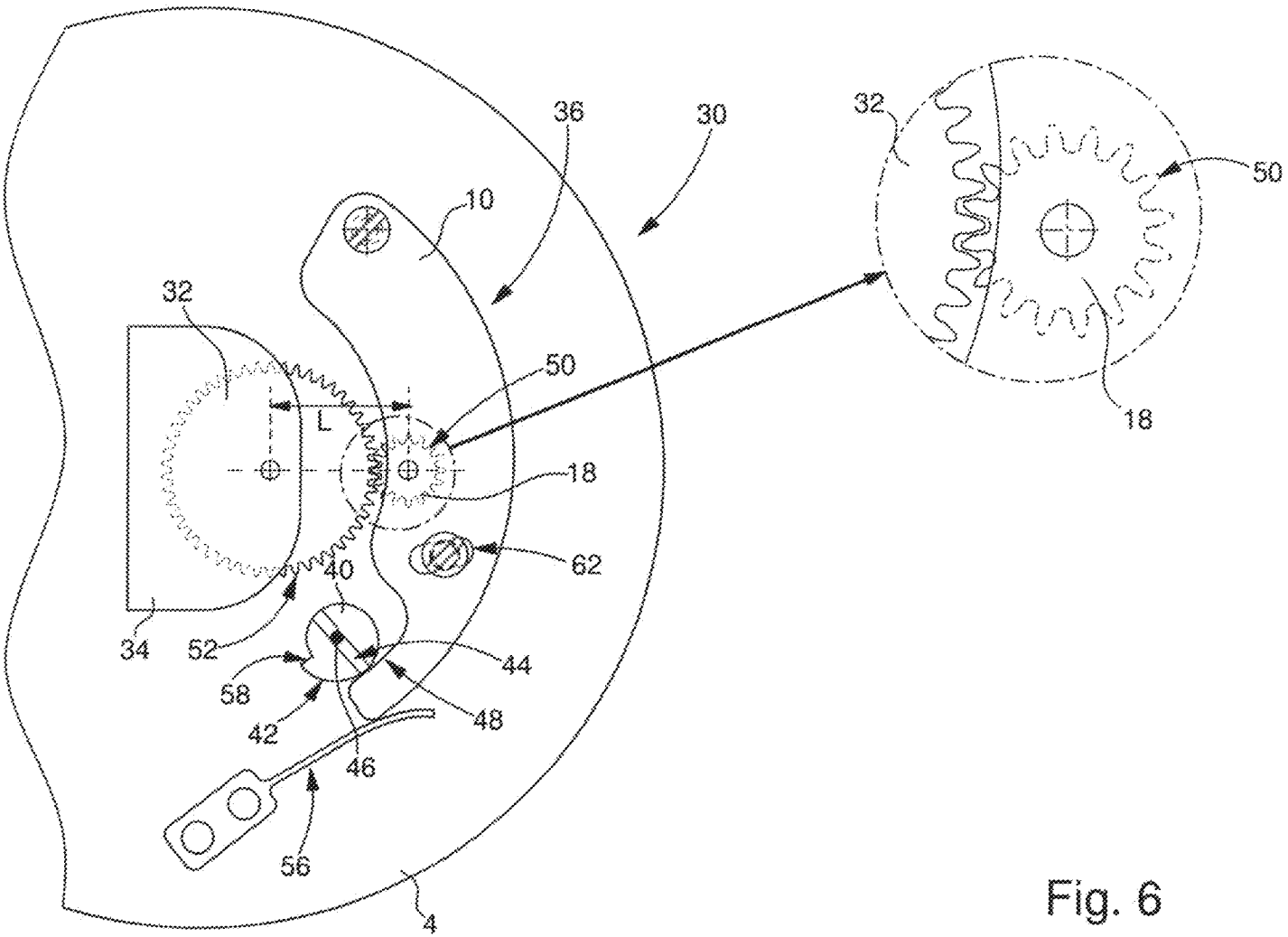
FIG. 6 is a similar view to that of FIG. 4, with the platform escapement in a final assembly position.

With reference to FIGS. 4 to 6, a timepiece movement of the aforementioned type will be schematically described with reference to FIGS. 1 to 3, but incorporating the present invention. The timepiece movement 30 is partially shown. There is shown, on the one hand, the fourth wheel 32, which is pivotally mounted between bottom plate 4 and a bar 34, and, on the other hand, a platform escapement 36 carrying an escape wheel set of which only the escape pinion 18 is shown. This is sufficient to describe the present invention.

According to a first implementation of the method of adjusting the distance of centres L between a first timepiece wheel set 18, pivotally mounted in a module 36, which is able to undergo rotation about a geometric axis 38 relative to a base 4 on which it is mounted, and a second timepiece wheel set 32, which pivots on the base, there is arranged on the base a cam 40, at least most of the periphery 42 of which forms an Archimedes' spiral or an optimized Archimedes' spiral. This method includes the following steps:

A) Mounting the module 36, particularly a platform escapement, on base 4 in an initial position (FIG. 1), in which the first and second wheel sets do not mesh, so that, prior to being fixed to the base, if necessary, the platform escapement can rotate about a geometric axis 38 and so that a first lateral surface 48 of the module, at a distance from said geometric axis, can abut against cam 40 over a certain angular distance when said cam is rotated on itself, particularly using a screwdriver inserted in the slot 44 in said cam, friction mounted on an arbour 46 centred on the centre of the Archimedes' spiral or the optimized Archimedes' spiral.

B) Rotating the module about geometric axis 38 until the toothing 50 of first wheel set 18 penetrates toothing 52 of second wheel set 14 and abuts against said second wheel set (FIG. 5).

C) Angularly positioning cam 40 so that the cam is abutting against lateral surface 48 of said module with the first and second wheel sets in the resulting relative position of step B) above (FIG. 5).

D) After step C), rotating the cam over an angular distance substantially corresponding to a determined translation of the first wheel set relative to the second wheel set and holding lateral surface 48 in abutment against the cam, so as to increase the distance of centres L by partially withdrawing toothing 50 of the first wheel set from toothing 52 of the second wheel set over a determined distance (FIG. 6).

In the embodiment shown in FIGS. 4 to 6, module 36 is a platform escapement, first wheel set 18 is the escape pinion and the second wheel set 14 is a gear train wheel 32 mounted on a bottom plate 4 forming said base. In a particular variant, wheel 32 is the fourth wheel.

According to the invention, the lateral surface 42 of cam 40 forming the periphery of the cam substantially defines an Archimedes' spiral in a plane perpendicular to the axis of rotation of said cam. The Archimedes' spiral is the polar equation curve $R=P\cdot\theta$, where R is the radius at the centre and A is the angle travelled from the point of origin, i.e. the centre of the spiral. The parameter P may be chosen according to the particular configuration and the withdrawal value is provided to optimise the gearing of the two wheel sets. It may have a positive or negative mathematical sign. It should be noted that cam 40 has a negative sign. The spiral therefore has a pitch of $P\cdot 2\pi$ and has a remarkable characteristic, namely the fact that its distance of centre always increases by the same value for a given increase of angle $\theta$ regardless of the initial value of $\theta 0$. Consequently, a rotation of the cam through a determined angle corresponds to a determined increase in radius R regardless of the initial position of the cam. The invention takes advantage of this particular characteristic. When it is mentioned here that the lateral surface of the cam forms an Archimedes' spiral, it is clear that it is a coil of this type of spiral, for example the tenth or twentieth. In an improved variant, the Archimedes' spiral is optimised since the centre of the spiral is distinct from that of the two wheel sets and the abutment surface of the module against the cam is not always perpendicular to the direction of rotation (tangential direction) of the module. The Archimedes' spiral is thus optimised by calculating, particularly according to the positions of the two wheel sets, the position of the cam and the abutment surface of the module against said cam, in order to have the desired linear characteristic between the angle of rotation of the cam and the variation in the distance of centres of the two wheel sets.

The method according to the invention therefore proposes to insert the toothings of the two wheel sets concerned into each other until the wheel sets are locked against each other. This forms a particular position which is unaffected by manufacturing tolerances. In this particular position, the distance of centres is essentially defined by the dimensions of the two wheel sets with mesh with each other. It will be noted that, because of the side play of the wheel sets in their respective bearings, the two wheel sets are not located exactly in their free position. This problem could be taken into account during determination of the angular distance used in the aforementioned step D) of the method according to the invention.

The angle of rotation of cam 40 corresponds to a determined translation of said first wheel set relative to said second wheel set, regardless of the initial position of the cam when the two wheel sets are stopped. Thus, this determined translation used to optimise the gearing is unaffected by the various manufacturing tolerances, with the exception of the manufacturing tolerance of the cam. This follows from the specific profile provided for the periphery of the cam. In a preferred variant, the cam is calibrated so that the angle of rotation necessary to obtain the aforementioned determined translation corresponds to a predetermined angle.

In order to hold the module, in particular the lateral surface thereof in contact with the cam, properly in abutment against said cam during the controlled withdrawal of toothing 50 of the first wheel set from toothing 52 of the second wheel set, a spring 56 is provided in a variant of the method of the invention. This spring is preferably mounted after the platform escapement has been added to the bottom plate and brought into the position where the two wheels are in contact. In a variant, in order to bring the two wheel sets gently into a stopped position, the cam can be rotated in the direction which decreases the distance of centres of the two wheel sets. In another variant, once the two wheel sets are stopped against each other, cam 40 is angularly positioned so that the cam abuts against the lateral surface 48 of module 36. In this configuration, the cam has an initial position, for example that shown in FIG. 5. Next, the operator or an automated machine rotates the cam in the direction moving the first wheel set away from the second wheel set.

The cam axis will preferably be arranged according to the dispersion of manufacturing tolerances, so that the point or area of contact of said cam with the lateral surface 48 of module 36 is, if possible, substantially located in a predefined area of the coil formed by the cam periphery. In order to achieve this, account will be taken of the maximum tolerance of lateral abutment surface 48 in the intermediate position where the two wheel sets are abutting against each other relative to the cam mounted on bottom plate 4 and also of the direction in which the cam is rotated to perform the controlled, predetermined withdrawal. By way of example, in the case of a platform escapement, the withdrawal is 0.05 mm to ensure that the movement operates properly. If the maximum tolerance for positioning the cam axis relative to the contact surface of the platform escapement is, for example, +/−0.075 mm, the pitch of the selected spiral must have at least 0.2 mm for a withdrawal of 0.05 mm and for a maximum variation of 0.15 mm in the relative positioning of the cam and the module. Since the angular distance for withdrawal is always in the same direction, the theoretical position of the cam axis is provided so that the theoretical position of contact with the module in its aforementioned intermediate position is at an angular distance corresponding to an increase of 0.075 mm from the recess/notch 58 of the cam periphery in the direction of rotation that moves the first wheel set away from the second wheel set. This ensures that the cam can be rotated to perform the 0.05 mm translation for the determined withdrawal in every case. In the example given, the withdrawal advantageously corresponds to an angle of 90°, which an operator can easily achieve approximately, simply by observing the initial position of the slot 44 on the cam in the intermediate position and visually locating the final position into which the cam has to be brought, i.e. in this case perpendicular to the initial position. It will be noted that, because of recess 58, a spiral pitch slightly greater than the maximum limit will preferably be chosen.

In a second implementation of the method of the invention (not shown), the cam is mounted in module 36 and is thus integral therewith. In this case, the lateral surface against which the cam abuts is that of a portion integral with base 4. The method of adjusting the distance of centres of the two wheel sets remains similar to that of the first implementation described above. It is technical reversal which those skilled in the art can easily devise.

In a preferred variant where the module is rigidly fixed in its final position by at least one screw, the top bar has an oblong hole 62 opposite which there is a threaded hole 64 in bottom plate 4. The platform escapement is thus fixed in the final position by a flat head screw 76 passing through the oblong hole. The threaded hole may also be provided in a pin which is partially inserted into the oblong hole. A threaded hole 66 is also provided on axis of rotation 38 of the platform escapement for a second screw 78. The hole is coaxial to said axis of rotation.

It will be noted that the method of adjusting the distance of centres according to the invention may also be achieved by a cam which is temporarily arranged on the base or on the module, in particular using a tool comprising the cam of the invention. The tool and the base or module then include complementary means of positioning the tool at a given location and rotating the tool precisely to achieve the desired adjustment, particularly about a geometric axis passing through the centre of the Archimedes' spiral or the optimized Archimedes' spiral.

The invention also concerns the timepiece movement 30 arranged to implement the aforementioned method of adjusting the gearing of two wheel sets. This timepiece movement includes a module 36 provided with a first wheel set 18 meshing with the second wheel set 32 pivoting on a base 4 on which the module is mounted. Prior, if necessary, to being rigidly fixed to the base, this module is mounted on the base so that it can rotate horizontally about a geometric axis 38. In the embodiment shown in FIGS. 4 to 6, a foot or pin 66 of the base is arranged in a hole in module 36. According to the invention, the movement includes a positioning means formed by a cam 40, at least most of the periphery 42 of which forms an Archimedes' spiral. The cam is preferably calibrated. The choice of an Archimedes' spiral was explained above.

A lateral surface 48 of module 36, at a distance from geometric axis 38, can be pressed against the cam over a certain angular distance when the cam is rotated on itself. In particular, this lateral surface can be pressed against the cam at least when the latter is rotated between an intermediate position in which the two wheel sets 18 and 32 are in abutment against each other with their respective toothings penetrating each other, and an end position in which the two wheel sets are at a given distance from each other to release them and increase the gearing efficiency of the two wheel sets. Lateral surface 48 is located in a first area opposite, relative to a geometric plane 70 defined by the parallel axes of rotation 72 and 74 of the first and second wheel sets, to a second area in which the geometric axis 38 is located. The distance L between these two axes of rotation defines the distance of centres, which is adjusted, according to the invention, by rotating the cam over a given angular distance, corresponding to a determined translation of the first wheel set relative to the second wheel set, from a particular position in which the toothing of the first wheel set penetrates as far as possible the toothing of the second wheel set. This particular position has the advantage of being determined only by the dimensions of the two wheel sets and of being unaffected by manufacturing tolerances. Owing to the cam of the invention, it is possible to perform a determined withdrawal to optimise the relative position of the toothings of the two wheel sets.

As mentioned previously, the present invention is particularly useful when the module is a platform escapement, the first wheel set is the escape pinion and the second wheel set is a gear train wheel mounted on a plate forming said base. In general, it is the last wheel of the gear train, in particular the fourth wheel.

What is claimed is:

1. A timepiece movement including a module, fitted with a first wheel set meshing with a second wheel set which pivots on a base, on which said module is mounted, and a means of positioning the module on said base, wherein said positioning means is formed by a cam, most of the periphery of which forms an Archimedes' spiral or an optimized Archimedes' spiral, said cam being arranged so as to allow the distance of centres between the first and second wheel sets to be adjusted when the cam is rotated about the centre of said Archimedes' spiral or said optimized Archimedes' spiral.

2. The timepiece movement according to claim 1, wherein said cam is substantially calibrated.

3. The timepiece movement according to claim 1, wherein, prior to being rigidly fixed to said base, said module is capable of rotating about a geometric axis and wherein a lateral surface of the module, at a distance from said geometric axis, is capable of remaining in abutment against said cam, fixed to said base, over a certain angular distance when said cam is rotated about the centre of said Archimedes' spiral.

4. The timepiece movement according to claim 3, wherein said lateral surface is located in a first area opposite, relative to a geometric plane defined by the parallel axes of rotation of the first and second wheel sets, to a second area in which said geometric axis is located.

5. The timepiece movement according to claim 1, wherein said module is a platform escapement, said first wheel set being an escape pinion and said second wheel set being a gear train wheel mounted on a plate forming said base.

6. A method of adjusting the distance of centres between a first timepiece wheel set, pivotally mounted in a module, which is capable of undergoing rotation about a geometric axis relative to a base on which said module is mounted, and a second timepiece wheel set which pivots on said base, said method being wherein a cam is permanently or temporarily secured to the base or to the module, most of the periphery of said cam forming an Archimedes' spiral or an optimized Archimedes' spiral, and wherein the method includes the following steps:

A) Mounting the module on said base, so that, prior to being rigidly fixed to the base, the module can rotate about said geometric axis and so that a lateral surface of said module, or of a part fixed to said base, depending on whether the cam is respectively fixed to the base or the module, can abut against said cam over a certain angular distance when said cam is rotated about the centre of said Archimedes' spiral or said optimized Archimedes' spiral;

B) Rotating said module about said geometric axis until the toothing of the first wheel set penetrates the toothing of the second wheel set and abuts against said second wheel set;

C) Angularly positioning said cam so that the cam is abutting against said lateral surface with the first and second wheel sets in the resulting relative position of step B);

D) After step C), rotating said cam over an angular distance substantially corresponding to a determined translation of said first wheel set relative to said second wheel set, so as to increase said distance of centres by partially withdrawing the toothing of the first wheel set from the toothing of the second wheel set and holding said lateral surface in abutment against said cam.

7. The method according to claim 6, wherein said cam is calibrated so that said angular distance corresponds to a predetermined angle.

8. The method according to claim 6, wherein said lateral surface is held in abutment against said cam by a spring.

9. The method according to claim 6, wherein said module is a platform escapement, said first wheel set being the escape pinion and said second wheel set being a gear train wheel mounted on a bottom plate forming said base.

10. The method according to claim 6, wherein, after step D), said module is rigidly fixed to said base by at least one screw.

* * * * *